United States Patent [19]

Jordan

[11] Patent Number: 4,704,835

[45] Date of Patent: Nov. 10, 1987

[54] HOOK STRIP FOR REMOVABLE WALL PANELS

[76] Inventor: Lamar Jordan, 20550 Maybank, Dallas, Tex. 75220

[21] Appl. No.: 781,430

[22] Filed: Sep. 30, 1985

[51] Int. Cl.[4] ..... E04B 2/58; E04B 1/56

[52] U.S. Cl. ..... 52/486; 52/489; 52/511; 52/766

[58] Field of Search ..... 52/486, 489, 582, 584, 52/580, 766, 506, 509, 510, 235, 511; 211/191, 192; 248/225.2

[56] References Cited

U.S. PATENT DOCUMENTS

| | | | |
|---|---|---|---|
| 2,068,863 | 1/1937 | Mannshardt | 110/1 |
| 2,963,132 | 12/1960 | Rosenbaum | 189/88 |
| 3,103,708 | 9/1963 | Pomeroy et al. | 52/511 X |
| 3,229,435 | 1/1966 | Olsen | 52/489 |
| 3,312,027 | 4/1967 | Lawer | 52/475 |
| 3,550,338 | 12/1970 | Satkin et al. | 52/241 |
| 3,608,266 | 7/1971 | Satkin et al. | 52/741 |
| 3,722,163 | 3/1973 | Satkin et al. | 52/122 |
| 4,330,974 | 5/1982 | Fleisch et al. | 52/486 |
| 4,457,436 | 7/1984 | Kelley | 248/225.2 |
| 4,458,462 | 7/1984 | Schold | 52/281 |

FOREIGN PATENT DOCUMENTS

| | | | |
|---|---|---|---|
| 2803449 | 8/1979 | Fed. Rep. of Germany | 52/489 |

*Primary Examiner*—Alfred C. Perham
*Attorney, Agent, or Firm*—David H. Semmes

[57] ABSTRACT

Removable partition systems of the type embodying top and bottom tracks enclosing a plurality of channel shaped vertical studs and vertical wall panels secured to the studs by means of hooks extending from the inner surface of the panel to engage notches defined in the studs. The improvement consists in a hook strip secured to the inner face of the wall panel and including a hardened planar surface and a downwardly extending hook. The hook includes inclined top and bottom edges, a horizontal bight and an inwardly protruding camming surface. The horizontal bight rests upon the bottom of the notch, while the camming surface tension fits the inner surface of the stud so as to securely mount the wall panel with respect to the stud.

4 Claims, 9 Drawing Figures

HOOK STRIP FOR REMOVABLE WALL PANELS

BACKGROUND OF THE INVENTION (1) Field of the Invention

Wall structures, particularly removable partition systems of the type embodying top and bottom tracks enclosing a plurality of channel shaped vertical studs having panel notches defined in their sides and vertical wall panels secured to said channel shaped studs by means of hooks engaging the panel notches.

(2) Description of the Prior Art

MANNSHARDT: U.S. Pat. No. 2,068,863
HENNING: U.S. Pat. No. 2,230,247
ROSENBAUM: U.S. Pat. No. 2,963,132
SLOWINSKI: U.S. Pat. No. 3,243,930
LAWER: U.S. Pat. No. 3,312,027
PESTEL: et al. U.S. Pat. No. 3,341,997
SATKIN: et al. U.S. Pat. No. 3,550,338
SATKIN: et al. U.S. Pat. No. 3,608,266
SATKIN: et al. U.S. Pat. No. 3,722,163
SCHOLD: U.S. Pat. No. 4,458,462

The foregoing references are being discussed in an Information Disclosure Statement being submitted separately.

SUMMARY OF THE INVENTION

An improved hook strip of the type attachable to the inner surface of removable wall panels, such that an offset hook engages corresponding panel notches defined in channel shaped vertical studs. The improvement consists in the construction of the hook strip, such that the downwardly extending hook includes a downwardly extending top edge and an upwardly extending bottom edge and a camming surface protruding inwardly beyond the inclined bottom edge. The hook thus fits complementally within the panel notches such that the horizontal bight of the hook rests upon the lower portion of the notch, while the camming surface engages the inner surface of the channel shaped stud and tensions the stud, so as to securely mount the panel thereón.

DESCRIPTION OF THE PREFERRED EMBODIMENT

Figure 1:
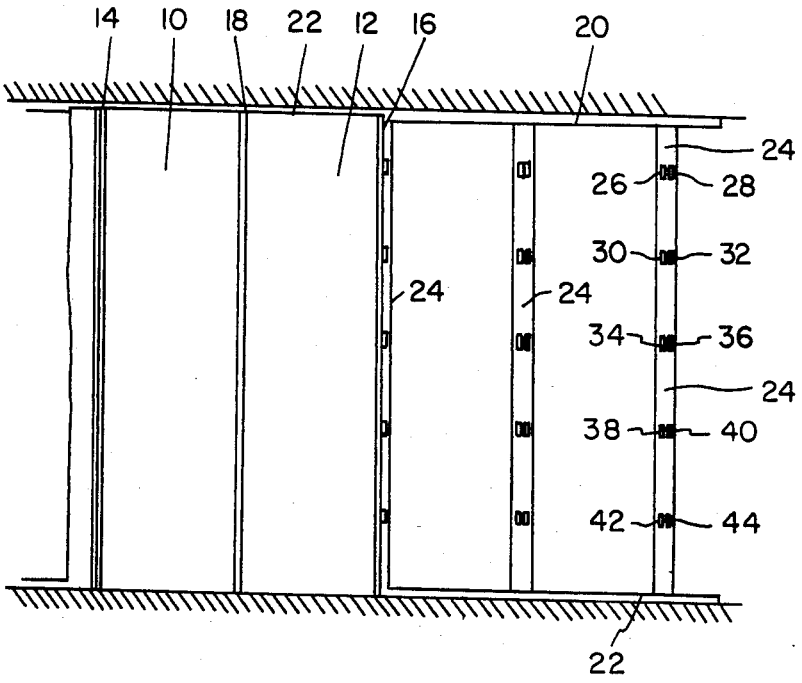
FIG. 1 is a front elevational view of a removable wall panel system involving channel shaped vertical studs supporting two removable wall panels.

FIG. 1 is a front elevation of a removeable partition wall involving a ceiling runner 20 and a flooring runner 22, enclosing a plurality of vertically extending channel shaped studs 24. Pairs of notches, 26-28, 30-32, 34-36, 38-40, 42-44, are defined in the studs 24 so as to mount the wall panels 10, 12 in abutting relationship. As will be apparent in FIG. 1, the edges 14, 16 of the individual panels abut as at 18 and the top edge 22 extends above ceiling runner 20.

Figure 2:
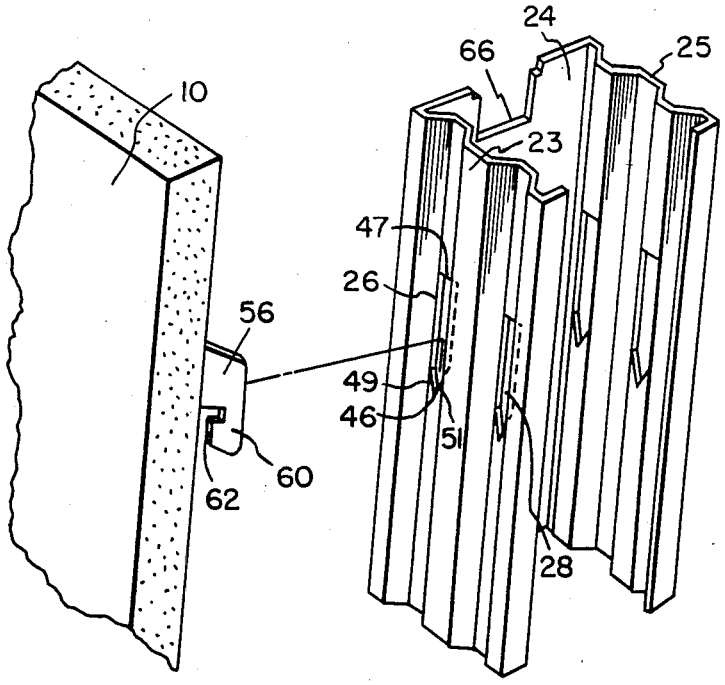
FIG. 2 is a fragmentary exploded view, showing the wall panel offset hook in an attitude of near engagement with the corresponding notch in the channel shaped stud.

In FIG. 2, the wall panel 10 is shown with its hook 60 bent at right angles to complementally engage corresponding notch 26 of the pair 26-28 defined in channel shaped stud 24.

Figure 9:
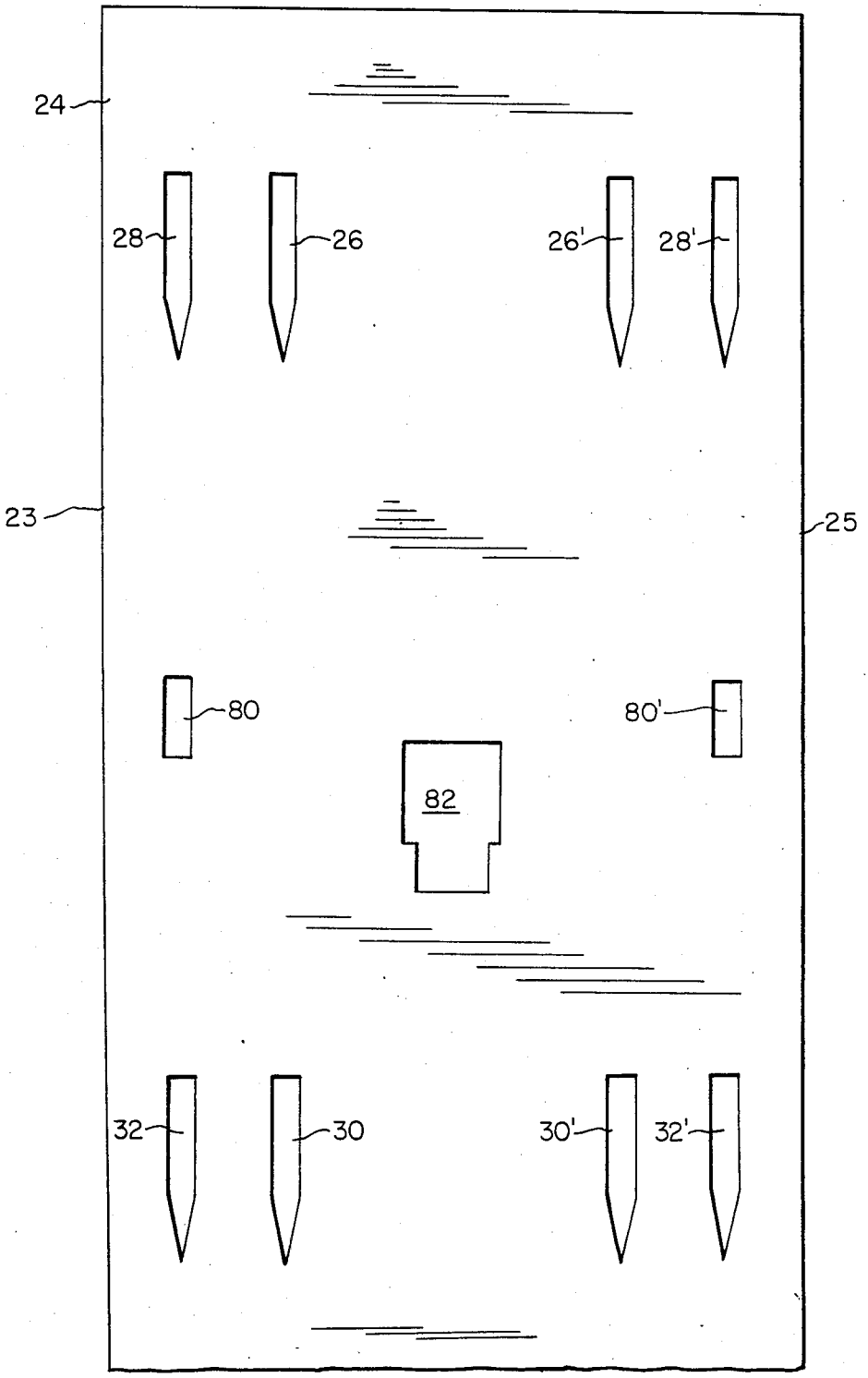
FIG. 9 is a fragmentary plan of a portion of a channel stud with pairs of notches cut at 9" intervals and with the center notch and spacer cutouts.

Channel shaped stud 24 includes upper indexing aperture 26 as well as front surface 23 and rear surface 25. The individual notches, such as 26, include a top edge 47 and a pair of converging lower edges 49, 51 which converge as at 46. As illustrated in FIG. 9, spacers 80-80' and a center notch 82 may be aligned intermediate the pairs of notches.

Figure 3:
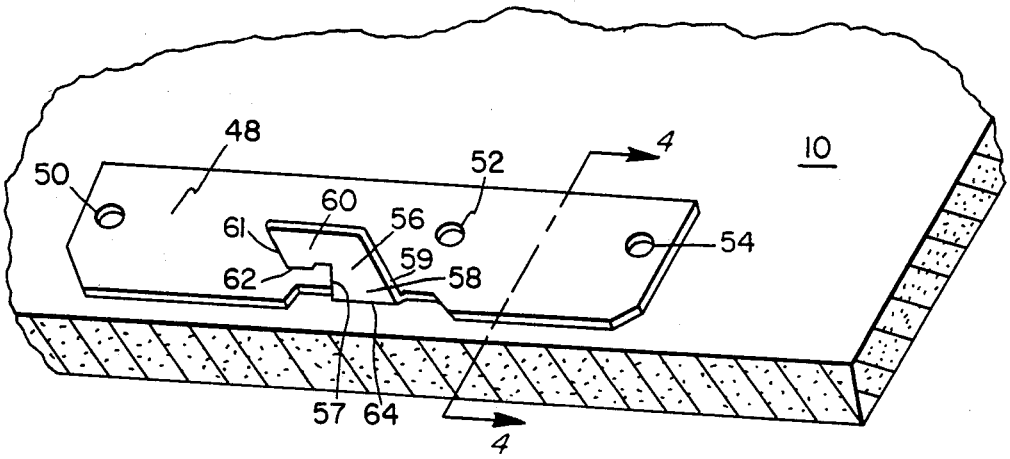
FIG. 3 is a fragmentary perspective showing securement of the hook strip to the inside edge of the wall panel, while the hook is bent at right angles with respect to the hook strip for engagement with the corresponding notch in the stud.
Figure 4:
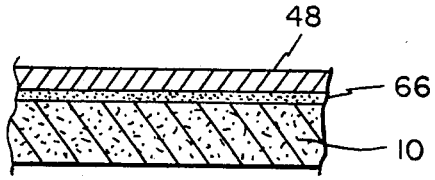
FIG. 4 is a fragmentary vertical section showing securement of the hook strip by gluing or epoxy to the wall panel.

In FIG. 3, wall panel 10 is shown fragmentarily with the hook strip 48 secured thereto by means of a gluing material (not shown) or by the use of conventional securing means mountable in apertures 50, 52, 54. The hook which is bent as at 64 at right angles includes upper portion 58, including upper inclined edge 59 and downwardly extending hook portion or shank 60. Shank 60 has a lower upwardly inclined edge 61 and a camming surface 62 which extends inwardly from the inclined surface. The horizontal bight 57 of the hook engages the notch convergence 46. In FIG. 4, the hook strip 48 is shown as secured by means of gluing 66 to wall panel 10.

Figure 5:
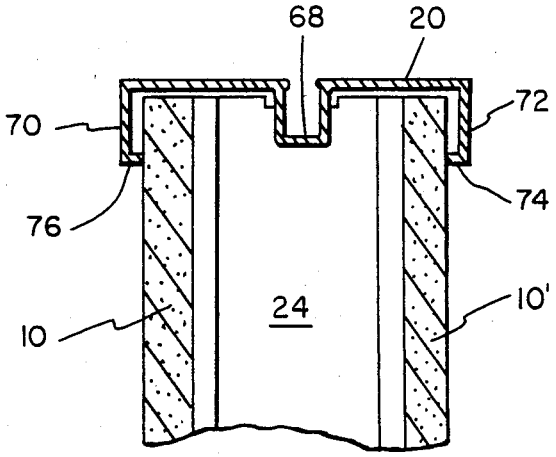
FIG. 5 is a fragmentary section showing securement of the front panel 10 and rear panel 10' to the stud and stabilizing at the top by means of runner 20.

In FIG. 5, the wall panels 10 and 10' are shown as secured to channel shaped stud 24 and at their tops are stabilized by means of top runner 20 having indexing feature 68 engaging corresponding recess 66 in stud 24. Runner 20 may include front edge 70 with inwardly extending rib 76 and back edge 72 with inwardly extending rib 74.

Figure 6:
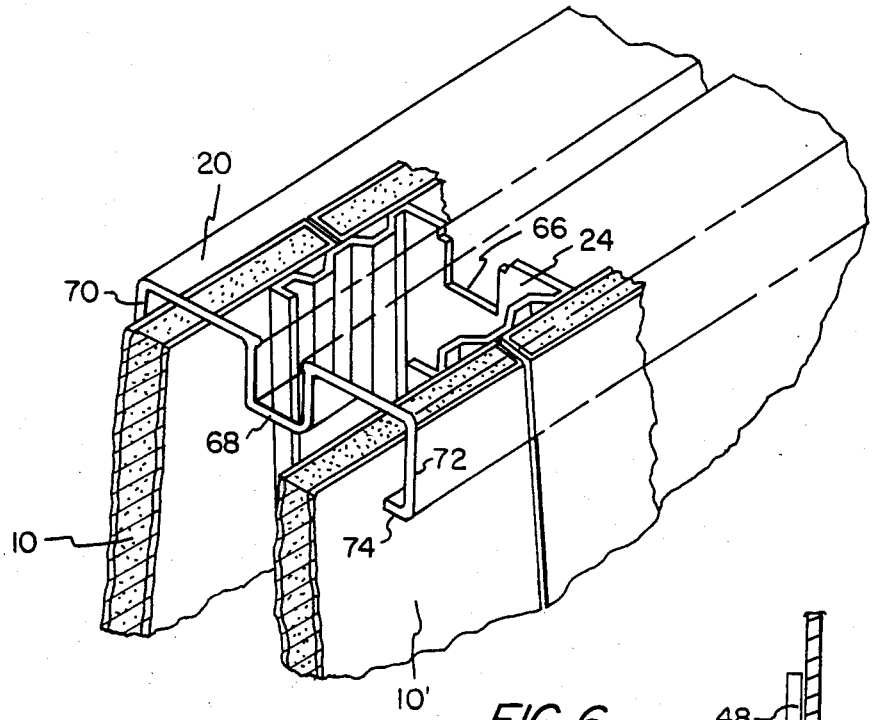
FIG. 6 is a fragmentary perspective showing engagement of the front panel 10 and rear panel 10' with respect to stud 24 and the runner 20.

In FIG. 6, panels 10 and 10' are shown as set in place with respect to runner 20.

Figure 7:
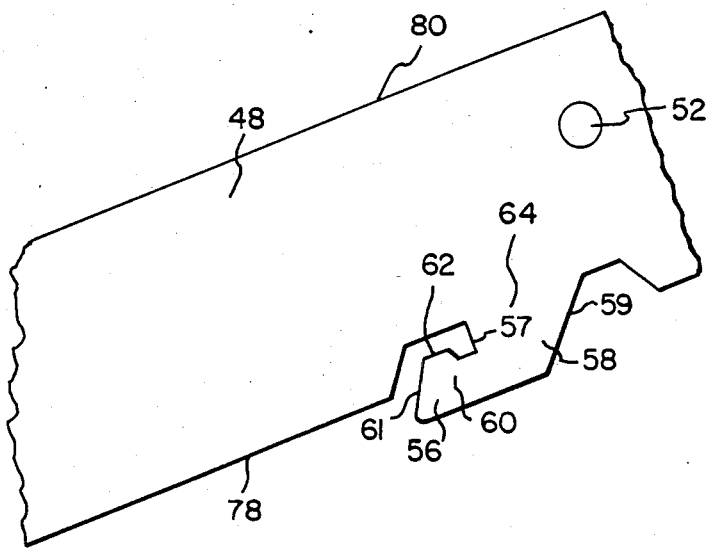
FIG. 7 is a fragmentary top plan of a hook strip, according to the present invention.

FIG. 7 is a fragmentary showing of hook strip 68 together with the offset feature of the hook 56, including shank portion 60 and upper portion 58.

Figure 8:
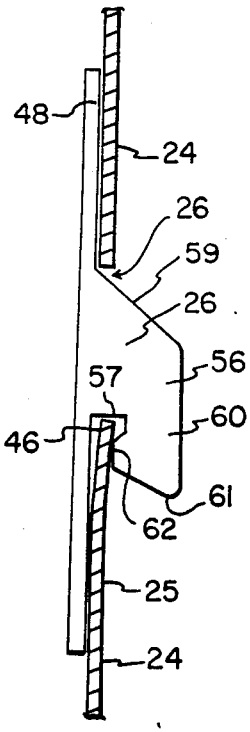
FIG. 8 is a fragmentary side elevation, partially in section, showing engagement of the hook strip hook with respect to the notch 26 defined in the channel shaped stud 24.

In FIG. 8, the engagement of hook 56 with notch 26 defined in stud 24 is shown. The downwardly inclined upper edge 59 and the upwardly inclined lower edge 61 of the hook complementally engaging the notch upper and lower limits, as the hook is set within notch 26, such that the bight 57 engages the notch convergence 46 while the camming surface 62 is pressed against the inner surface 25 of stud 24. This camming fit enables a tensioning of stud 24, such that the wall panel 10 is more securely set with respect to the stud and the more easily removed, as the panel is lifted upwardly and outwardly such that the hook 56 is removed from notch 26 and the camming surface 62 is relieved of its pressure upon the inner surface of stud 24.

Conventional hook strips are without a protuberence 62 and, therefore, the hook inner surface beneath the bight simply rests in parallel to the inner surface of the stud and without tensioning of the stud. Thus, conventional panels are not tension-fitted and are inclined to wobble or to be dislocated with respect to each other and the supporting channel shaped studs.

Manifestly, the hook strip may be manufactured of a variety of malleable materials and may be secured to the wall panels by any of several conventional glues or plasticizers as well as by mechanical riveting or the like.

I claim:

1. In removable partition systems of the type embodying top and bottom tracks enclosing a plurality of channel shaped vertical studs having panel notches defined in their sides and vertical wall panels secured to said channel shaped studs by means of the panel notches, the improvement comprising:

(A) a hook strip secured to the inner face of the wall panels adjacent the vertical edges of said wall panels, said hook strip further including;

(i) a hardened planar surface;

(ii) a downwardly extending hook offset with respect to the leading edge of said planar surface and dimensioned so as to extend through the notch within said channel shaped stud; said hook further including:

(a) a downwardly inclined upper edge, so as to complementally engage the upper edge of the notch within the channel shaped stud, as said hook is being extended through and set within the notch;

(b) an upwardly inclined lower edge so as to be engageable complementally with the panel notch in said channel shaped stud;

(iii) a vertical camming surface protruding inwardly beyond said inclined lower edge such that the hook extends complementally through said notch and said camming surface resiliently and complementally engages the inner surface of the channel shaped stud beneath the notch; and (iv) a horizontal bight extending between said hook and said hook strip above said vertical camming surface engaging the bottom of the notch as said camming surface engages the inner surface of the channel shaped stud.

2. In removable partition systems, a hook strip as in claim 1, said hook strip being manufactured from bendable metallic material.

3. In removable partition systems, a hook strip as in claim 2, said hook being bendable at right angles to said hook strip.

4. In removable partition systems, a hook strip as in claim 3, including a plurality of hook strips secured to the inner face of a wall panel, so that a plurality of bendable hooks engage a corresponding plurality of notches defined in an abutting channel shaped vertical stud.

* * * * *